US006644079B2

(12) United States Patent
Harman et al.

(10) Patent No.: US 6,644,079 B2
(45) Date of Patent: Nov. 11, 2003

(54) HAIRPIN BENDER WITH LEG LENGTH MEASUREMENT AND ADJUSTMENT FEATURE

(75) Inventors: Galen B. Harman, La Grange, IN (US); Derrick S. Small, Sturgis, MI (US); James G. Milliman, Sturgis, MI (US)

(73) Assignee: Burr Oak Tool and Gauge Company, Inc., Sturgis, MI (US)

( * ) Notice: Subject to any disclaimer, the term of this patent is extended or adjusted under 35 U.S.C. 154(b) by 33 days.

(21) Appl. No.: 10/028,207

(22) Filed: Dec. 21, 2001

(65) Prior Publication Data

US 2003/0115925 A1 Jun. 26, 2003

(51) Int. Cl.[7] ..... B21D 7/025

(52) U.S. Cl. ..... 72/15.4; 72/16.7; 72/149; 72/307

(58) Field of Search ..... 72/307, 149, 150, 72/16.7, 17.3, 18.5, 19.5, 14.8, 15.3, 369, 15.4

(56) References Cited

U.S. PATENT DOCUMENTS

| | | | | |
|---|---|---|---|---|
| 3,553,989 A | * | 1/1971 | Munro | 72/16.7 |
| 3,592,029 A | * | 7/1971 | Ritter et al. | 72/15.4 |
| 3,653,251 A | * | 4/1972 | Coonan | 72/369 |
| 5,233,853 A | | 8/1993 | Milliman | 72/302 |
| 5,259,224 A | * | 11/1993 | Schwarze | 72/16.4 |
| 5,305,223 A | * | 4/1994 | Saegusa | 700/165 |
| 5,379,624 A | | 1/1995 | Harman et al. | 72/149 |
| 5,617,753 A | * | 4/1997 | Glissman et al. | 72/149 |

OTHER PUBLICATIONS

Webpage print–out from Macro Sensors™ showing "Linear and Rotary Position Sensors" http://www.macrosensors.com/primer.htm (date unknown) (5 sheets).

Webpage print–out from Macro Sensors™ showing "Linear and Rotary Position Sensors" http://www.macrosensors.com/primer.htm (date unknown) (3 sheets).

* cited by examiner

*Primary Examiner*—Daniel C. Crane
(74) *Attorney, Agent, or Firm*—Flynn, Thiel, Boutell & Tanis, P.C.

(57) ABSTRACT

A method and apparatus for controlling the orienting of the ends of a finite length segment of tube following a bend thereof through a predefined angle. At least one straight finite length segment of tube is supplied to the tube bender for bending the tube about a bend axis. The two ends of the tube, following the bend, are measured to determine the distance between the end face of each leg to the bend axis. Appropriate adjustment is made to a pushing member to keep the ends of the tube in a generally coplanar relation. Additional measurement is performed to facilitate adjustment between the tube supply device and the tube bending mechanism.

32 Claims, 5 Drawing Sheets

HAIRPIN BENDER WITH LEG LENGTH MEASUREMENT AND ADJUSTMENT FEATURE

FIELD OF THE INVENTION

This invention relates a tube length control method and apparatus for a tube bending mechanism and, more particularly, is an improvement to the tube bending structures illustrated in U.S. Pat. Nos. 5,233,853 and 5,379,624.

BACKGROUND OF THE INVENTION

U.S. Pat. No. 5,233,853 discloses a device for simultaneously stretch straightening a plurality of side-by-side oriented segments of tubing for use in manufacturing heat exchangers and bending that tubing to form hairpin tubes. In the process of manufacturing a plurality of hairpin tubes simultaneously, difficulty was being encountered in keeping the legs of the "U" of the hairpin tubes to the same length. U.S. Pat. No. 5,379,624 provides a solution to that particular problem, which problem is caused by varying frictional forces occurring as each tube is being bent so that following a bending of a plurality of tubes, the lengths of the respective legs would be substantially different.

Often users of the machines described in the two above referenced patents will process tubing from several different vendors at the same time. As a result, tubing that is side-by-side oriented on the tube bending mechanism behaves differently because of the continuous variations presented thereat due to tube hardness, tube lubrication, tube wall thickness amongst other things. Thus, it is desirable to provide a monitoring of the length of the legs of the "U" of each hairpin manufactured and to provide for an automatic variation in the orientation of components to maintain the ends of the legs of the "U" coplanar with each other.

Therefore, it is an object of this invention to provide a method and an apparatus which will effectively monitor the length of the legs of the hairpin tubes and automatically implement an adjustment to maintain within tolerance the length of the legs of each hairpin the tube manufactured and the beneficial aspects explained in the two aforementioned patents.

It is an object of the invention to provide a tube bending method and apparatus, as aforesaid, which will monitor and effect an accurate control of the length of the legs of the U-shaped hairpin tube to a prescribed length.

It is a further object of the invention to provide a hairpin bending method and apparatus, as aforesaid, which will facilitate the bending of a plurality of such hairpin tubes simultaneously, each of the plurality of hairpin tubes having legs of a precisely controlled length.

It is a further object of the invention to provide an improvement to the tube bending method and apparatus described and illustrated in U.S. Pat. Nos. 5,233,853 and 5,379,624.

SUMMARY OF THE INVENTION

In general, the objects and purposes of the invention are met by providing a tube bending method for bending and a tube bending mechanism configured to bend a finite length tube section supplied by a finite length tube supply into a U-shape, at least one end of the tube section being pushed by a pusher to a desired location. A tube end locating device is configured to locate at least one of first and second ends of the tube section following a bending operation and produce a signal indicative of a distance of one of the two ends from a bend axis of the U-shaped tube, the signal being indicative of one of the two ends being either too short or too long. A support is provided for supporting either the pusher or said tube bending mechanism at an adjustable distance from the finite length tube supply for facilitating adjustable relocation before a start of a next cycle of operation of the tube bending mechanism. A control mechanism responsive to the signal is provided to effect an adjustable relocation of either the pusher or the tube bending mechanism from the finite length tube supply so that following a next cycle of operation of the tube bending mechanism, at least one of the two ends will be oriented at least closer to the desired location.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DISCUSSION

Figure 1:
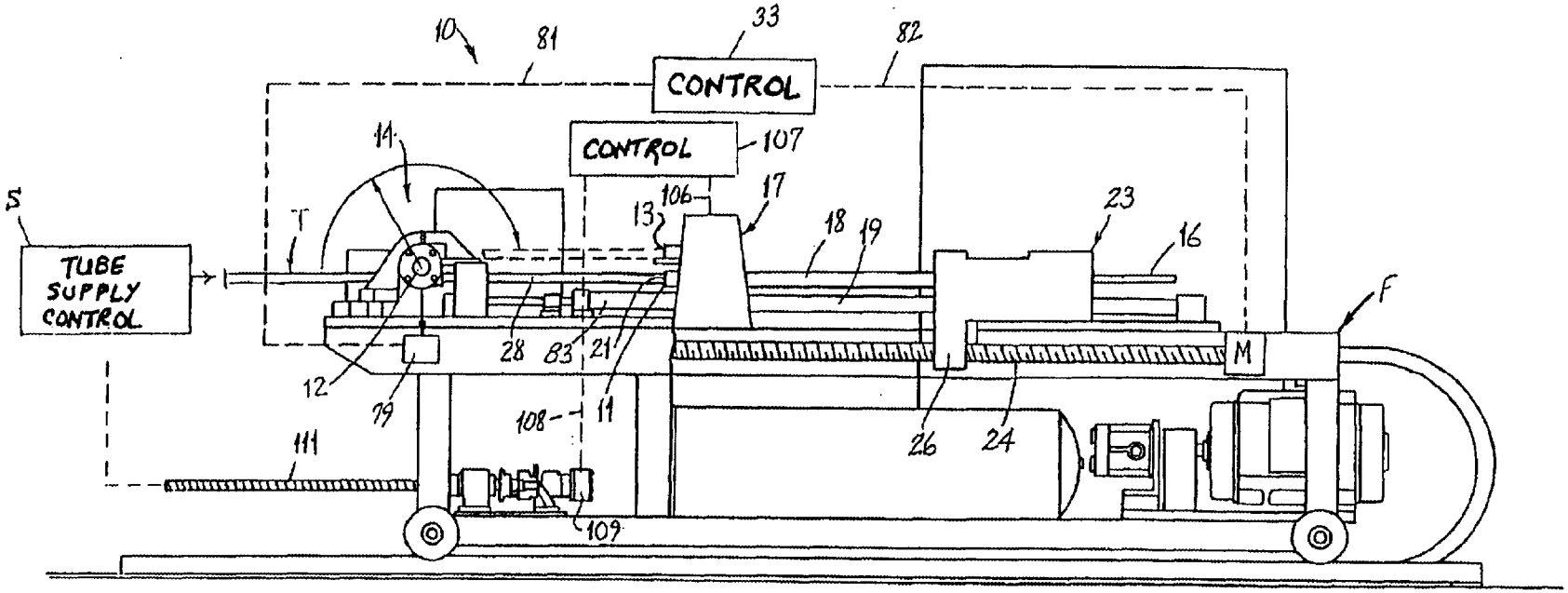
FIG. 1 is a side view of a tube bender embodying the invention.

Certain terminology will be used in the following description for convenience and reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include the words above specifically mentioned, derivatives thereof and words of similar import.

Since the starting point for the technology incorporated into this invention begins with the disclosures in U.S. Pat. Nos. 5,233,853 and 5,379,624, the disclosures of these references is to be incorporated herein by reference.

Figure 6:
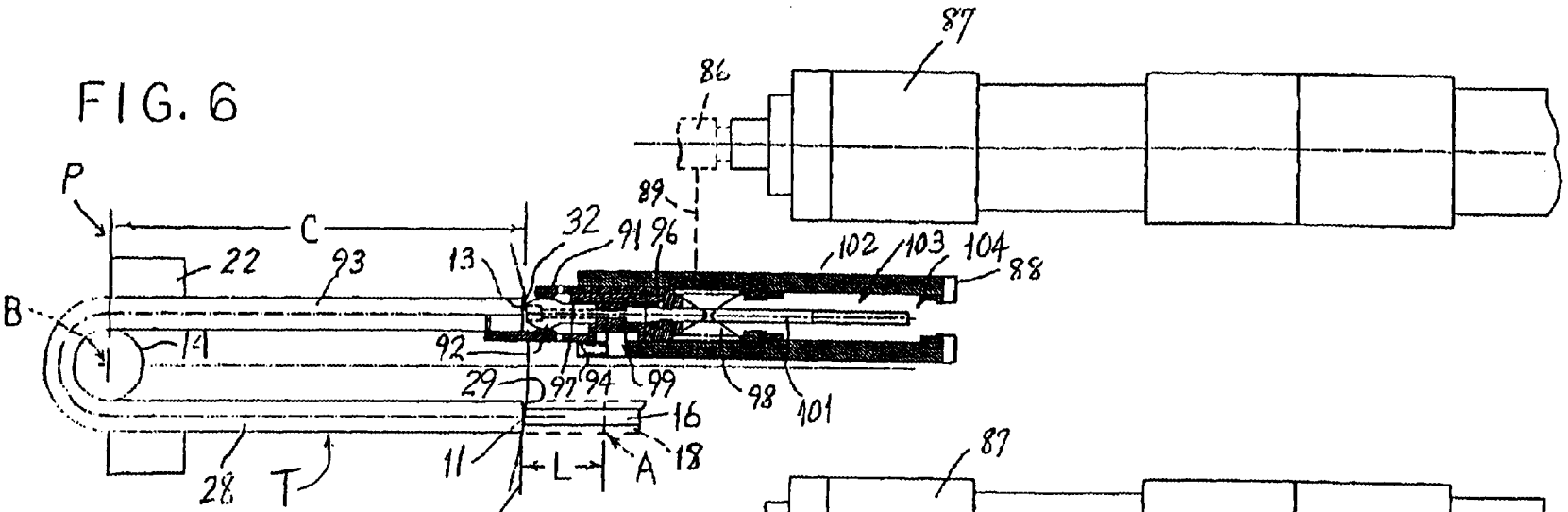
FIG. 6 is a fragmentary illustration of a tube length measuring device operatively associated with the second end of a U-shaped tube.

The tube supply control mechanism S is known from U.S. Pat. Nos. 5,233,853 and 5,379,624. The tube supply control S causes a plurality (here only one is shown) of finite length segments of tubing to be precut to a precise length and delivered to the tube bending device 10 so that a leading or first end 11 of each of the tubes T is oriented at a precise location "A" (FIG. 6) from a plane "P" oriented perpendicular to a longitudinal axis of the tube T and containing a bend axis "B" defined by a shaft 12. Since the opposite second end 13 of the tubes T are cut so that the tube segment length is of a precise dimension, the location of the second end thus becomes known prior to a bending of the tube into a U-shape. As is schematically shown in FIG. 6, a plurality (only one of which is shown) of tube mandrels 16 are provided and the tube segment is telescoped over the tube mandrels. The end of the tube mandrels 16 adjacent the bend axis B each have a not illustrated bend mandrel oriented closely adjacent the bend arbor 14, which bend arbor is pivotally supported on the shaft 12.

A guide structure 17 is provided on the tube bending mechanism 10. The guide structure 17 has a plurality of openings therein each slidably supporting a sleeve 18, also known as a stripper tube, inside of which is received the tube mandrels 16. If desired, the guide structure 17 can be adjusted along the length of a guide bar 19 mounted on a frame F of the tube bender 10 toward and away from the bend arbor 14. An end 21 of each sleeve 18 is positioned to engage the leading end or first end 11 of each of the tubes T after the tubes T have become fixedly oriented in the tube bender and a clamping mechanism 22 (FIG. 6) has been activated to effectively hold the tubes T in a fixed relation with the bend arbor 14. The clamp mechanism 22 is of a conventional design and is embodied in the structures illustrated in U.S. Pat. Nos. 5,233,853 and 5,379,624.

A first drive carriage 23 is slidably supported on the guide bars 19. The frame F also includes an elongated externally threaded shaft 24 extending lengthwise of the tube bender 10 and is driven for rotation by a motor M. The carriage 23 includes an internally threaded nut portion 26 which is threadedly engaged with the threads on the threaded rod 24 so that as the motor M drives the threaded rod 24 for rotation, the carriage 23 will be driven lengthwise of the plural guide rods 19 toward and away from the guide structure 17.

The purpose of the aforementioned structure is to cause the ends 21 of the sleeves 18 to be brought into engagement with the first ends 11 of the tubes T as illustrated in FIG. 1. The carriage 23 will first move into engagement with a flange 27 on each of the sleeves 18 to thence bring the aforesaid ends 21 into the mentioned engagement with the tube ends 11. Thereafter, and with the clamping mechanisms 22 effectively clamping each of the tube segments to the bend arbor 14, the bend arbor 14 is then pivoted about the shaft 12 to bring the aforementioned second ends 13 of the tubes T to a location adjacent the first ends 11 as illustrated in broken lines in FIG. 1. As the bend movement occurs, the carriage 23 will simultaneously move through a predetermined distance L (FIG. 6) to cause the ends 21 of each of the sleeves 18 to push on the first ends 11 of each of the tubes to cause the material of the leg 28 to be moved lengthwise to the left as the bend is occurring to fixedly orient an end face 29 of the leg 28 at a carefully controlled location 31. Since the position of the second tube end 13 of the tube T was known prior to the bend, its location at the completion of the bend illustrated in FIG. 6 is also such that the end face 32 is coplanar with the end face 29 at the controlled location 31.

The coordinated movement of the bend arbor 14 and the first drive carriage 23 is regulated by a control device 33 as is taught in the aforementioned U.S. Pat. No. 5,379,624 incorporated herein by reference. Thus, further commentary about this coordinated movement is believed unnecessary.

The first drive carriage 23 includes a frame 34 which includes a pair of spaced upstanding walls 36 and 37 between which is oriented a plurality of indexing mechanisms 38 corresponding in number to the number of tubes T being bent. Each indexing mechanism 38 consists of a shaft 39 having a pair of reduced diameter sections at opposite ends thereof received in axially aligned holes 41 in each of the walls 36 and 37. The shaft 39 has thereon oppositely oriented ratchet teeth 42 and 43 encircling same, which ratchet teeth 42 and 43 are adapted to be operatively connected to a reciprocating plunger 44 or 46 of a pair of respective pneumatically operated cylinders 47 and 48. Pulsed air pressure is supplied to the individual pneumatic cylinders 47 and 48 through air inlet connections 49 and 51, respectively. Each of the plungers 44 and 46 in the respective pneumatic cylinders 47 and 48 are air activated and spring returned to the original position. For example, pulsed air supplied to the air connection 49 will activate the pneumatic cylinder 46 to urge the plunger 44 thereof into engagement with the ratchet teeth 42 to cause rotation of the shaft 39 in a first direction of rotation whereas pulsed air supplied to the air connection 51 will cause the pneumatic cylinder 48 to be activated to urge the plunger 46 into engagement with the ratchet teeth 43 to cause rotation of the shaft 39 in the opposite direction of rotation.

The shaft 39 includes a reduced diameter, externally threaded shaft extension 52 extending, in this embodiment, in direction toward the bend arbor 14.

Figures 2, 3:
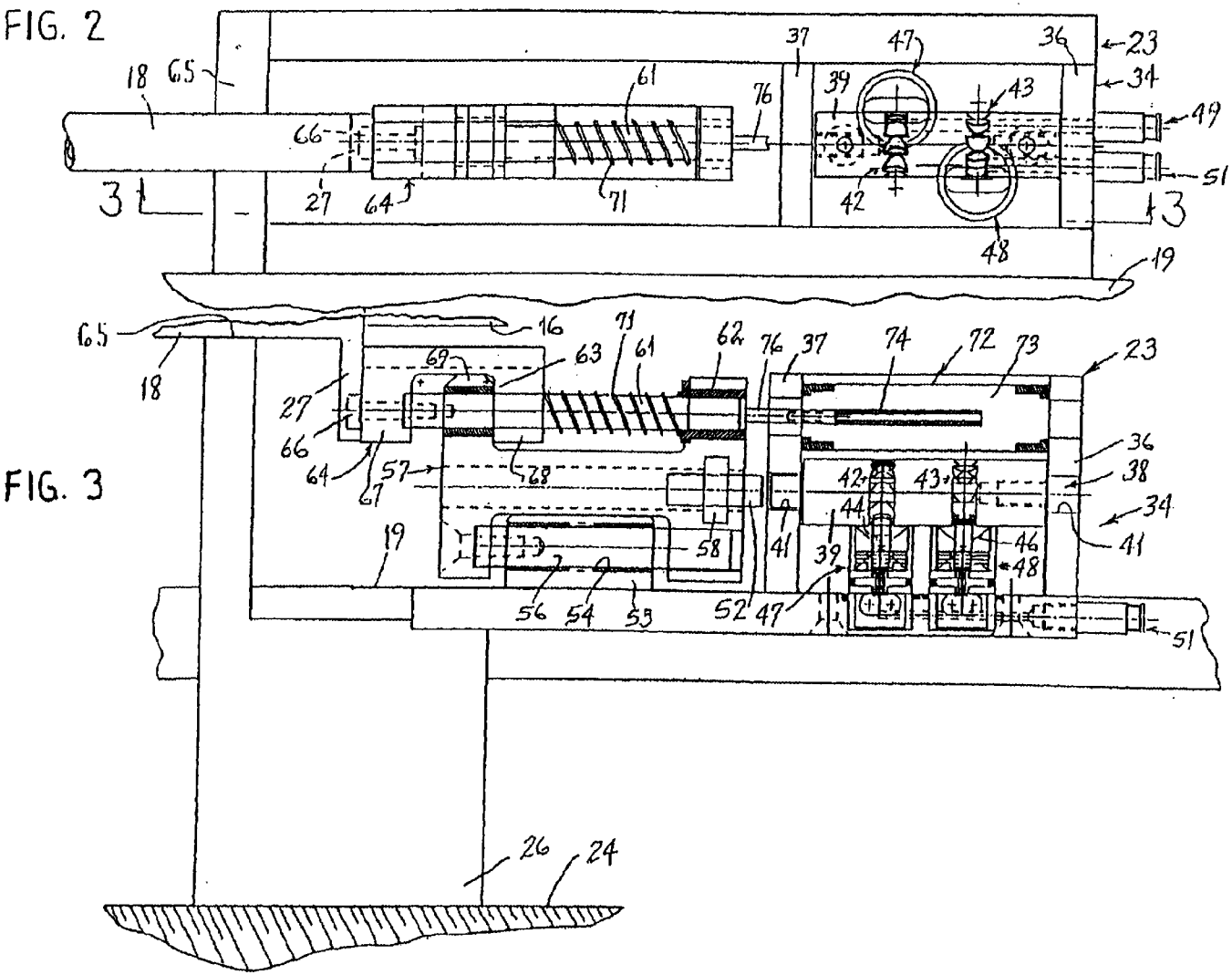
FIG. 2 is a top view of a drive carriage having thereon a tube engaging carriage.
FIG. 3 is a sectional view taken along the line 3—3 of FIG. 2.

The first drive carriage 23 additionally includes a plurality of embossments 53 corresponding in number to the number of tubes T being bent (only one of which is illustrated in FIG. 3). Each embossment 53 has a hole 54 extending therethrough, the axis of the hole being generally parallel to the longitudinal axis of the sleeves 18. An elongate rod 56 is slidably supported in the hole 54 for movement along the longitudinal axis thereof. An adjustment carriage 57 is secured to the ends of the elongate rod 56 so that the adjustment carriage 57 can be moved toward and away from the bend arbor 14. An internally threaded nut is provided on the adjustment carriage 57 and is threadedly engaged with the externally threaded shaft extension 52. As a result, rotation of the shaft 39 accompanied by the corresponding rotation of the shaft extension 52 will cause the adjustment carriage 57 to be advanced leftwardly or rightwardly (FIG. 3).

The adjustment carriage 57 includes an additional elongate rod 61 supported for axial movement in axially aligned bushings 62 and 63. A tube engaging carriage 64 is fixedly secured to the elongate rod 61 by a screw 66. If desired, the end of the sleeve 18 adjacent the tube engaging carriage 64 is guided on a guide track 65 on the first drive carriage 23. In this particular embodiment, the tube engaging carriage 64 is of an inverted U-shape in FIG. 3 wherein legs 67 and 68 straddle a flange section 69 of the adjustment carriage 57 housing the bushing 63. A compression spring 71 is oriented between the bushing 62 and the flange housing it and the tube engaging carriage 64 so as to continually urge the tube engaging carriage 64 toward the bend arbor 14.

Figure 5:
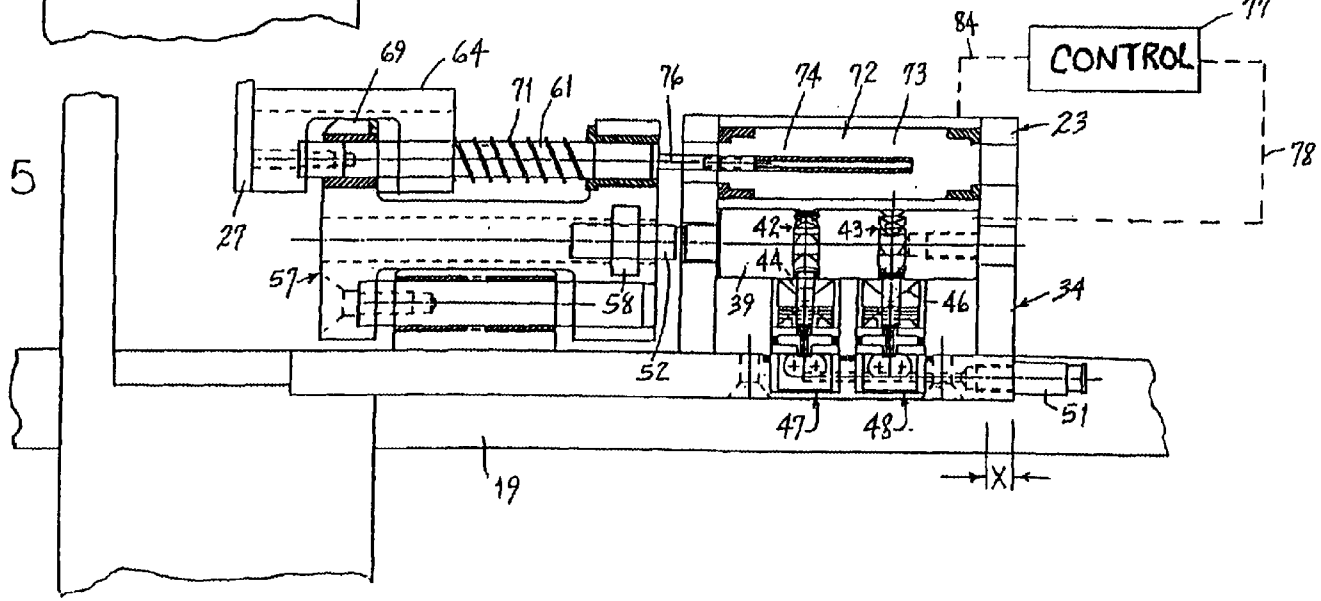
FIG. 5 is a sectional view like FIG. 4 except that the tube engaging carriage has been shifted relative to the drive carriage.

The first drive carriage 23 additionally includes a plurality of linear variable differential transformer (LVDT) devices 72 corresponding in number to the number of tubes T being bent. Each LVDT device 72 is oriented between the walls 36 and 37 of the frame 34. Each LVDT device 72 is a conventional off the shelf device available from Macro Sensors, a division of Howard A. Schaevitz Technologies, Inc. of Pennsauken, N.J. The particular model of LVDT used in this construction is a model 375-250. Information about the LVDT device 17 can be reviewed at the supplier's website located at http://www.macrosensors.com/primer.htm. Each LVDT device 72 includes a core component 73 oriented between the walls 36 and 37 of the frame 34. The moving element 74 of the LVDT device 72 is secured by a shaft extension 76 of the shaft 61 so that reciprocable movement of the shaft 61 will cause simultaneous reciprocal movement of the moveable movement 74 inside the core 73 of the LVDT device 72. The operation of the LVDT is well known and is explained in the aforesaid website. To summarize the operation, axial movement of the movable member 74 inside the core 73 will produce an electric signal indicative of the position of the movable member 74 inside the core 73. The positional sensitivity of the movable member 74 inside the core can be detected to as little as 0.0001 inch. The output signal from the LVDT is fed to a control device 77 (FIG. 5). The output of the control device is fed by a line 78 to control the direction of rotation of the shaft 39 as schematically illustrated in FIG. 5, it, of course, being recognized that the output through the line 78 would be to a further conventional control mechanism (not illustrated) for determining which of the air connections 49 and 51 would be activated to determine the direction of rotation of the shaft 39.

As is disclosed in U.S. Pat. No. 5,379,624, the first drive carriage 23 and the bend arbor 14 are linked by the control device 33 so that the number of degrees through which the tube has been bent is measured by a detector 79 (FIG. 1) and a corresponding signal therefrom is fed thorough a control line 81 to the control device 33. The control device 33 in turn produces a signal fed through the control line 82 to the motor M so that the threaded rod 24 will be rotated through a prescribed number of revolutions for each degree of rotation of the bend arbor 14 about the shaft 12 driven by a drive device 83. As a result, the first drive carriage 23 will be moved in a slaved relation to the movement of the bend arbor about the axis of the shaft 12 toward the left to bring the ends 22 of the respective sleeves 18 into engagement with the leading end faces 29 of the first ends 11 of the tubes T. Thereafter, and for each degree of movement of the bend arbor 14 about the shaft 12, the control device 33 will control the operation of the motor M so that the first drive carriage 23 will be moved a prescribed distance L (FIG. 6) to forcibly place the end faces 29 of the first ends 11 of each of the tubes at the prescribed location 31 illustrated in FIG. 6. The location 31 will coincide with the location of the end faces 32 of the second ends 13 of each of the tubes following a bend of the tubes to a U-shape as illustrated in FIG. 6.

Figure 4:
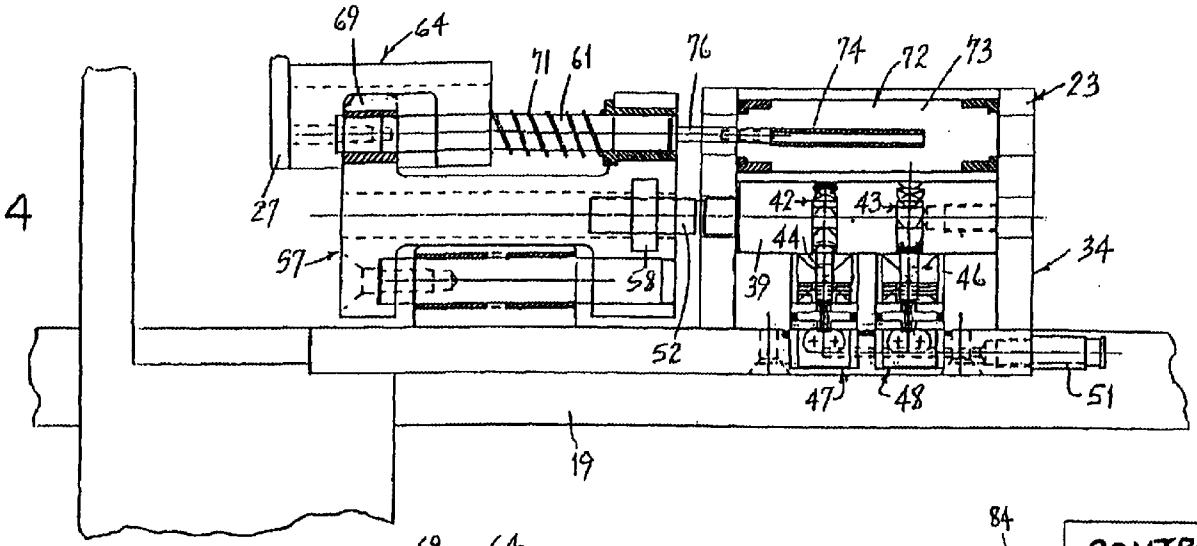
FIG. 4 is a sectional view like FIG. 3 except that the components of the drive carriage have been shifted.

As the tube engaging carriage 64 engages the right end of a sleeve 18, particularly the flange 27 thereof in response to a movement of the first drive carriage 23 toward the bend arbor 14, the tube engaging carriage 64 will be shifted rightwardly from the FIG. 3 position to the FIG. 4 position against the continual urging of the spring 71. The tube engaging carriage 64 will remain in the position shown in FIG. 4 as the first drive carriage 23 is advanced toward the bend arbor 14. Once the sleeve 18 has driven a respective end face 29 of the first end 11 to the prescribed location 31 through the distance L, the first drive carriage 23 is thereafter moved to the right a distance "X" (FIG. 5) to cause the compressed material of the respective legs 28 to relax and enable the springs 71 to maintain the light urging of each of the tube engaging carriages 64 into engagement with the respective flange 27 of the sleeve 18. That is, the springs 71 will not cause the material of legs 28 to be compressed. Since the shaft 61 carries with it through the shaft extension 76 the movable member 74 of the LVDT device 72, the precise location of the end face 29 of the first end 11 of each tube T will then be measured by the respective LVDT device 72 associated with each of the tubes to produce an electrical signal fed through the line 84 to the control device 77. The control device 77 will have preprogrammed therein the desired location of the end face 29 and the data received through the lines 84 will be compared to the predetermined location and if the end face 29 is not at the desired location, a signal will be fed through the line 78 to effect a controlled rotation of the shaft 39 and extension 52 thereof to cause the adjustment carriage 57 to be advanced leftwardly or rightwardly of the frame 34 so that when the first drive carriage 23 is retracted to its initial starting position, the springs 71 will return all of the now positionally adjusted tube engaging carriages 64 into engagement with the wall 69 as illustrated in the initial starting position of FIG. 3. This adjustment will in effect control the length of travel that force is applied to the end face 29 during the next cycle so that when the force is removed from the end face 29, any compressive forces in the material of the legs 28 will become relaxed and the end face 29 will assume the adjusted location to keep the end faces 29 and 32 in as close as possible coplanar relation.

In some instances, it is desired to measure the precise location of the end face 32 relative to the bend axis B (distance "C" in FIG. 6) This is accomplished by providing on the guide structure 17 the structure illustrated in FIGS. 6–9. More specifically, a second drive carriage 86 is provided on the guide structure 17 and is reciprocably driven relative to the guide structure 17 by a drive device 87. The second drive carriage 86 is connected to a frame member 88 by a schematically illustrated connection 89. The frame member 88 is hollow and includes at the left end thereof, and for each tube T that is being examined, a carriage 91 movable with respect to the frame member 88. Each carriage 91 is in the form of a hollow sizing sleeve inside of which there is provided a sizing tool 92 oriented in axial alignment with the longitudinal axis of the leg 93 of the tube T. The inside diameter of the sizing sleeve part of the carriage 91 is of a preferred external diameter for the leg 93. The diameter of the sizing tool 92 is of a preferred internal diameter for the leg 93. A lost motion connection 94 is provided between the frame member 88 and the carriage 91. The purpose of the lost motion connection 94 will become apparent below. A slide mechanism 96 is guided inside the frame 88 on the same path as the carriage 91. The slide mechanism 96 has an extension piece 97 that extends through a guide opening in the carriage 91 so that the left distal end thereof terminates proximate the sizing tool 92 as illustrated in FIG. 6. A compression spring 98 (schematically illustrated in FIG. 6) is provided for continually urging the slide mechanism 96 and the carriage 91 toward the end face 32 of the tube T regulated by the positioning of a stop 99.

A shaft 101 extends from the slide mechanism 96 on a side thereof remote from the end face 32 of the tube T. The shaft 101 has adjacent the distal end thereof a movable member 102 inside the core 103 of a further LVDT device 104. The output of the LVDT device 104 is fed through a line 106 to a control device 107 (FIG. 8), the output of which is connected through a line 108 to a motor 109 (FIG. 1).

Figure 7:
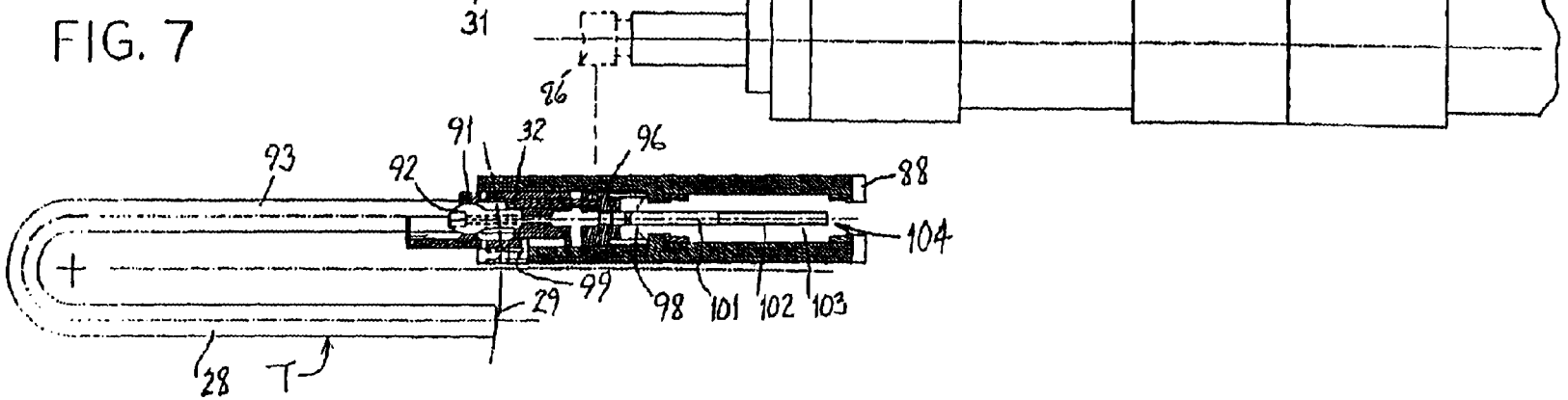
FIG. 7 is a view like FIG. 6 except that a further drive carriage is shifted along a path toward the second end of the U-shaped tube.

In measuring the location of the end face 32 of the leg 93 of each tube T, the starting position for the measurement is illustrated in FIG. 6. Thereafter, the second drive carriage 86 is advanced toward the bend arbor 14, namely to the FIG. 7 position to cause the lost motion connections 94 to be taken up and the stops 99 engaged with the carriages 91 to drive them so that the sizing sleeve part of each carriage 91 will encircle the exterior of the respective leg 93 and the sizing tool 92 will enter the interior of the leg 93 to size both the external and the internal diameter of the respective leg to the dimension of the sizing sleeves and the sizing tools 92. The extensions 97 on each of the slide mechanisms 96 will engage the respective end face 32 and be shifted relative to the respective carriages 91 as illustrated in FIG. 7 against the urging of the respective springs 98. As a result, the shafts 101 carrying the movable members 102 will be shifted inside the respective cores 103 of the LVDT devices 104 to indicate through the control device 107 which has programmed therein the preferred location of the end face 32 of each tube T. A measurement of the actual variation between the preferred location for each end face 32 and the actual position thereof is noted by the program in the control device 107 and if a discrepancy is determined, the control device 107 will initiate through a signal sent through the line 108 to the motor 109 an adjustment of the relative position between the tube bending device 10 and the tube supply control S through an externally threaded screw member 111. Typically, since the tubes T are clamped in the clamping device 22, all of the end faces 32 of the tubes will likely be at the same location. If they are not, an alarm will be activated to alert the operator to the problem.

Figure 8:
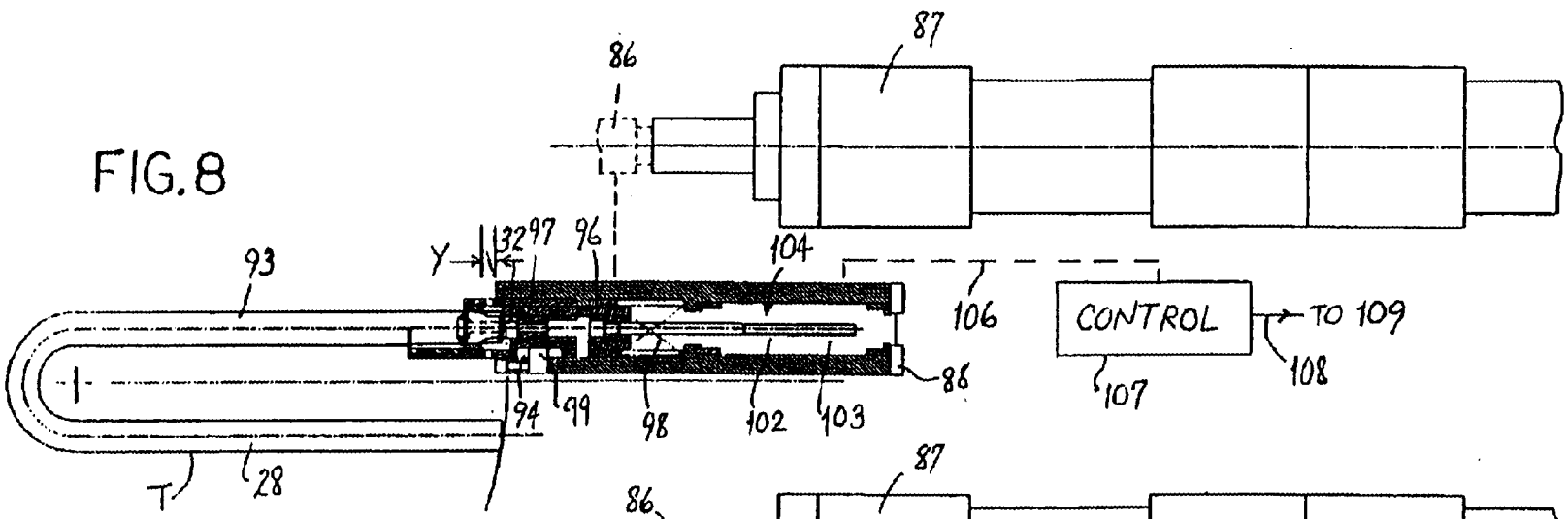
FIG. 8 is a view like FIG. 7 except that the further drive carriage has been shifted in a direction away from the second end of the U-shaped tube.
Figure 9:
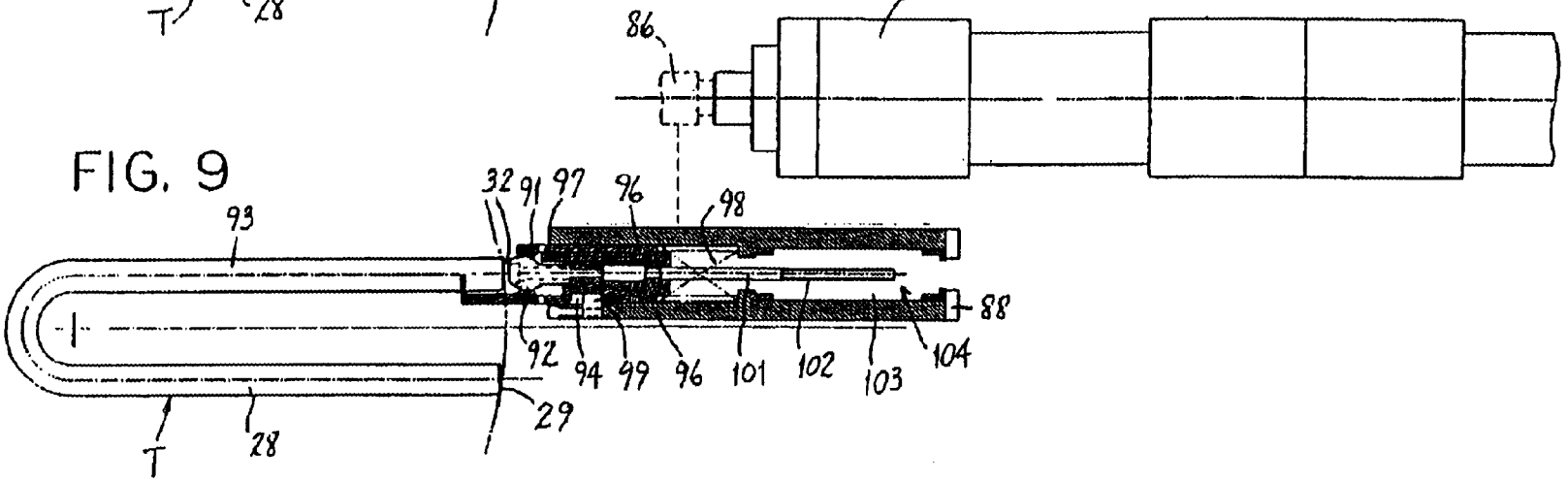
FIG. 9 is a view like FIG. 6, namely, the further drive carriage has been returned to the initial start position as illustrated in FIG. 6.

Prior to the aforesaid measurement, it will be noted that the second drive carriage 86 is moved away from the end face 32 by the distance "Y" (as shown in FIG. 8) to retract the stop 99. However, the spring 98 continues to urge the extension 97 of the slide mechanism 96 into engagement with the end face 32. As a result, any compressive forces in the material of the leg 93 caused by inserting the sizing tool into the opening into the end face 32 will become relaxed so that the precise location of the end face 32 will be determined by the appropriate location of the movable member 102 in the core 103 of the LVDT device 104.

Thereafter, the second drive carriage 86 is retracted to its initial start position, the stop 99 engaging the carriage 91 to retract the sizing tool 92 from inside the leg 93 and simultaneously urge the slide mechanism 96 therewith.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a tube length control device for controlling a length of each of a pair of legs of a U-shaped bent tube defined by a distance between an axis of a bend in said U-shaped bent tube and each free end of said U-shaped bent tube, said tube length control device comprising:

a tube bending device;

supply and delivery means for intermittently supplying at least one finite length segment of tubing and delivering said finite length segment to said tube bending device, said tube bending device having a bend arbor pivotal about a bend axis, said supply and delivery means causing a first end of said finite length segment to be delivered to said tube bending device;

clamping means on said bend arbor and initially oriented on a side of said bend axis adjacent said supply and delivery means for clamping said finite length segment to said bend arbor and thereby fixedly orienting a second end of said finite length segment from said bend axis;

first drive means for drivingly pivoting said bend arbor through a predefined angle to effect a bending of said finite length segment;

first control means for limiting the delivery of said finite length segment to said tube bending device so that the first end thereof is oriented a predetermined distance on a side of a plane, oriented perpendicular to a longitudinal axis of said finite length segment and containing said bend axis, that is remote from said supply and delivery means;

second drive means for drivingly engaging said first end of said finite length segment and for pushing said first end toward said clamping means;

second control means for halting the movement of said second drive means toward said bend axis at a location whereat said first end, following the predefined angle of bend, becomes generally coplanar with said second end, the improvement wherein:

said second drive means includes a first drive carriage supported for movement along a first path parallel to a longitudinal axis of said at least one finite length segment of tubing, said first drive carriage having thereon a tube engaging carriage selectively adjustably movable relative to said first drive carriage along a second path parallel to said first path, said tube engaging carriage being configured to engage said first end of said finite length segment; and a third control means is provided and being configured for measuring the actual distance between said plane and at least one of said first and second ends and for determining whether the measured actual distance is one of too short and too long and for effecting an adjustment of the position of said tube engaging carriage relative to said first drive carriage in order to effect a maintenance of the coplanar relation of said first and second ends within a selected tolerance.

2. The tube length control device according to claim 1, wherein said supply and delivery means is adjustably spaced from said tube bending device and said third control means is additionally configured to adjust the spacing between said supply and delivery means and said tube bending device in response to a determination that the measured actual distance is one of too short and too long.

3. The tube length control device according to claim 1, wherein said third control means is configured to perform the measured actual distance task and effect adjustment between cycles of operation of said tube bending device.

4. The tube length control device according to claim 1, wherein said first drive carriage includes a first guide track extending along said second path parallel to said first path and on which is guided at least one adjustment carriage.

5. The tube length control device according to claim 4, wherein said first drive carriage additionally includes an indexable drive motor for effecting movement of said at least one adjustment carriage relative to said first drive carriage along said first guide track.

6. The tube length control device according to claim 5, wherein said at least one adjustment carriage includes a second guide track extending along a third path and on which is movably guided said tube engaging carriage.

7. The tube length control device according to claim 6, wherein said third path is parallel to said second path.

8. The tube length control device according to claim 6, wherein said at least one adjustment carriage additionally includes a resiliently yieldable means for continually urging said tube engaging carriage toward said supply and delivery means.

9. The tube length control device according to claim 8, wherein said second drive means includes a third guide track and an elongate stripper tube slidably supported on said third guide track for movement lengthwise thereof, one end of said stripper tube engaging said tube engaging carriage while an opposite end thereof engages said first end of said finite length segment, said resiliently yieldable means assuring a maintained contact of said stripper tube with said tube engaging carriage and said first end.

10. The tube length control device according to claim 9, wherein said third guide track is provided on said first drive carriage.

11. The tube length control device according to claim 4, wherein said first drive carriage includes a first part of a two part linear variable differential transformer and said adjustment carriage includes a second part of said two part linear variable differential transformer, said linear variable differential transformer being configured to convert a relative motion between said first drive carriage and said adjustment carriage into a corresponding electrical signal indicative of a spacing between said first drive carriage and said adjustment carriage and thence the measured actual distance.

12. The tube length control device according to claim 11, wherein said first drive carriage additionally includes an indexable drive motor for effecting movement of said adjustment carriage relative to said first drive carriage along said first guide track.

13. The tube length control device according to claim 12, wherein said adjustment carriage includes a second guide track extending along a third path and on which is movably guided said tube engaging carriage.

14. The tube length control device according to claim 13, wherein said third path is parallel to said second path.

15. The tube length control device according to claim 13, wherein said adjustment carriage additionally includes a resiliently yieldable means for continually urging said tube engaging carriage toward said supply and delivery means.

16. The tube length control device according to claim 15, wherein said second drive means includes a third guide track and an elongate stripper tube slidably supported on said third guide track for movement lengthwise thereof, one end of said stripper tube engaging said tube engaging carriage while an opposite end thereof engages said first end of said finite length segment, said resiliently yieldable means assuring a maintained contact of said stripper tube with said tube engaging carriage and said first end.

17. The tube length control device according to claim 16, wherein said third guide track is provided on said first drive carriage.

18. The tube length control device according to claim 4, wherein said first drive carriage additionally includes an indexable drive motor for effecting movement of said adjustment carriage relative to said first drive carriage along said first guide track, said indexable drive motor including a rotatable output shaft configured to selectively rotate in opposite directions of rotation and having external threads thereon, said adjustment carriage having an internally threaded nut threadedly engaged with said threads on said output shaft.

19. The tube length control device according to claim 18, wherein said output shaft includes oppositely oriented ratchet teeth thereon, said indexable drive motor additionally including a pair of selectively reciprocable pawls engagable with selected ratchet teeth to effect upon separate activation of said pawls rotation of said output shaft in opposite directions of rotation.

20. The tube length control device according to claim 1, wherein said third control means is solely configured to measure the actual distance between said plane and said first end.

21. The tube length control device according to claim 20, wherein said tube bending device includes a fourth control means configured to measure the actual distance between said plane and said second end.

22. The tube length control device according to claim 21, wherein said fourth control means includes a second drive carriage supported for movement relative to said tube bending device along a path toward and away from said second end coaxially to a longitudinal axis of a leg of said U-shaped bent tube terminating in said second end.

23. The tube length control device according to claim 22, wherein said second drive carriage has mounted thereon a two part linear variable differential transformer, a first part of said two parts being fixed to said second drive carriage and movable therewith, a second part of said two parts being carried by said first part and configured to engage said second end and move relative to said first part, said linear variable differential transformer being configured to convert a relative motion between said first and second parts into a corresponding electrical signal indicative of a spacing between said plane and said second end.

24. The tube length control device according to claim 23, wherein said second part includes a profiled sizing tool configured to be received inside said second end and cold work said second end to the profile of said profiled sizing tool.

25. The tube length control device according to claim 24, wherein said profiled sizing tool is mounted on a slide movably guided on a track provided on said first part, said second part being movable relative to said slide on said track as well as engage said profiled sizing tool in response to a movement of said second drive carriage toward said second end to effect an urging of said profiled sizing tool into an interior of said second end and said second part into engagement with said second end.

26. The tube length control device according to claim 25, wherein said first part additionally includes a resiliently yieldable means for continually urging said second part toward said second end.

27. The tube length control device according to claim 22, wherein said second drive carriage includes a profiled sizing tool configured to be received inside said second end and cold work said second end to the profile of said profiled sizing tool.

28. A method for controlling a length of a pair of legs of a U-shaped bent tube defined by a distance between a bend axis in said U-shaped bent tube and each free end of said U-shaped bent tube, comprising the steps of:

establishing a desired distance between said bend axis and at least one of first and second ends of said pair of legs of said U-shaped tube;

supplying and delivering at least one straight finite length segment of tube having said first and second ends to a tube bender for bending said tube about the bend axis;

orienting said first end of said finite length segment a predetermined distance on a side of a plane oriented perpendicular to a longitudinal axis of said finite length segment and containing the bend axis about which said finite length segment is to be bent, said side being remote from said supply and delivery means;

clamping said finite length segment to a bend arbor for movement therewith;

moving the bend arbor through a predefined angle to effect a bending of the finite length segment while simultaneously pushing the first end of said finite length segment toward a location whereat said finite length segment is clamped to said bend arbor; and halting the pushing of the first end, following the predefined angle of bend, at a location whereat the first end becomes generally coplanar with the second end, the improvement comprising:

measuring the actual distance between said plane and at least one of said first and second ends and producing an actual distance measurement signal;

comparing said actual distance measurement signal to said established desired distance to produce a further signal indicative of whether the measured actual distance is one of too short and too long;

effecting in response to the further signal an adjustment of at least one of the location of the bend axis relative to at least one of a tube supply and delivery mechanism and an initial position of a pusher that pushes on said first end during a bending of said tube in order to effect a maintenance of the coplanar relation of said first and second ends within a selected tolerance.

29. The method according to claim 28, wherein said measuring step is performed between tube bending cycles.

30. The method according to claim 28, wherein said measuring step simultaneously measures the actual distance between said plane and said first and second ends.

31. In a tube bending mechanism configured to bend a finite length tube section supplied by a finite length tube supply into a U-shape, at least one end of said tube section being pushed by a pusher to a desired location, the improvement comprising:

means for establishing a desired distance between a bend axis and at least one of first and second ends of said pair of legs of said U-shaped tube;

a tube end locating device configured to locate at least one of said first and second ends of said tube section following a bending operation and produce a signal indicative of a distance of said at least one of said first and second ends from said bend axis of said U-shaped tube;

means for comparing said signal to said desired distance to produce a further signal indicative of said at least one of said first and second ends being one of too short and too long;

support means for supporting at least one of said pusher and said tube bending mechanism at an adjustable distance from said finite length tube supply for facilitating adjustable relocation before a start of a next cycle of operation of said tube bending mechanism; and control means responsive to said further signal to effect an adjustable relocation of said at least one of said pusher and said tube bending mechanism from said finite length tube supply so that following a next cycle of operation of said tube bending mechanism, said at least one of said first and second ends will be oriented at least closer to said desired distance.

32. In a method for bending a finite length tube section supplied to a tube bending mechanism by a finite length tube supply into a U-shape, one end of said tube being pushed by a pusher to a desired location, the improvement comprising:

establishing a desired distance between at least one of first and second ends of said tube section following a bending operation;

producing a signal indicative of an actual distance of said at least one of said first and second ends from a bend axis of said U-shaped tube, comparing said signal to said desired distance to produce a further signal indicative of said at least one of said first and second ends being one of too short and too long;

effecting in response to said further signal an adjustment of at a distance of at least one of an ending location of said pusher at a completion of a bending cycle and a spacing between said bend axis and said finite length tube supply so that following the completion of a next cycle of operation of said tube bending mechanism, said at least one of said first and second ends will be oriented at least closer to said desired distance.

* * * * *